US007286787B2

(12) United States Patent
Baek et al.

(10) Patent No.: US 7,286,787 B2
(45) Date of Patent: Oct. 23, 2007

(54) SHUTTER FOR A DEVELOPING UNIT OF AN ELECTROPHOTOGRAPHIC IMAGE FORMING APPARATUS

(75) Inventors: Chung-guk Baek, Suwon-si (KR); Jun-ho Lee, Seoul (KR)

(73) Assignee: Samsung Electronics, Co., Ltd., Suwon-si, Gyeonggi-do (KR)

( * ) Notice: Subject to any disclaimer, the term of this patent is extended or adjusted under 35 U.S.C. 154(b) by 189 days.

(21) Appl. No.: 11/132,307

(22) Filed: May 19, 2005

(65) Prior Publication Data

US 2006/0093400 A1 May 4, 2006

(30) Foreign Application Priority Data

Oct. 29, 2004 (KR) ..... 10-2004-0087064

(51) Int. Cl.
*G03G 21/18* (2006.01)
*G03G 21/16* (2006.01)

(52) U.S. Cl. ..... 399/114; 399/111

(58) Field of Classification Search ..... 399/111, 399/114, 116, 119
See application file for complete search history.

(56) References Cited

U.S. PATENT DOCUMENTS 5,974,287 A * 10/1999 Kurz et al. ..... 399/114
6,560,425 B1 5/2003 Lui et al.

FOREIGN PATENT DOCUMENTS

| | | |
|---|---|---|
| JP | 04-030178 | 2/1992 |
| JP | 09-026740 | 1/1997 |
| JP | 09-258635 | 10/1997 |
| JP | 09-292818 | 11/1997 |
| JP | 10-333530 | 12/1998 |
| JP | 2000-132068 | 5/2000 |
| KR | 1020020074083 | 9/2002 |

* cited by examiner

*Primary Examiner*—Hoang Ngo
(74) *Attorney, Agent, or Firm*—Roylance, Abrams, Berdo & Goodman, L.L.P.

(57) ABSTRACT

A developing unit and an electro-photographic image forming apparatus having the same are provid. The developing unit includes a housing and a photosensitive medium, which has an end exposed to the outer side of the housing and that is rotatably mounted on the housing. A photosensitive medium shutter shields the exposed part of the photosensitive medium when a door is opened and exposes the exposed part of the photosensitive medium to the outside when the door is closed. The photosensitive medium shutter includes a first shielding plate that is moved between a first location where the exposed part is shielded and a second location where the exposed part is exposed to the outside of the housing. A second shielding plate is spread at the first location with respect to the first shielding plate and is overlapped with the first shielding plate at the second location.

20 Claims, 5 Drawing Sheets

SHUTTER FOR A DEVELOPING UNIT OF AN ELECTROPHOTOGRAPHIC IMAGE FORMING APPARATUS

CROSS REFERENCE TO RELATED APPLICATION

This application claims the benefit under 35 U.S.C. § 119(a) of Korean Patent Application No. 10-2004-0087064 filed on, Oct. 29, 2004, in the Korean Intellectual Property Office, the entire disclosure of which is hereby incorporated by reference.

BACKGROUND OF THE INVENTION

1. Field of the Invention

The present invention relates to an electro-photographic image forming apparatus. More particularly, the present invention relates to a developing unit having a photosensitive medium shutter that shields a photosensitive medium for reducing light fatigue of the photosensitive medium and an electro-photographic image forming apparatus having the same.

2. Description of the Related Art

Generally, an electro-photographic image forming apparatus is an image printing machine that prints an image after forming an electrostatic latent image by scanning light onto a photosensitive medium charged to a predetermined potential. The electrostatic latent image is developed and fixed on the photosensitive medium into a visible image by applying a developing agent such as a toner, thereon.

FIG. 1 is a side view illustrating a conventional developing unit mounted in an inner side of an electro-photographic image forming apparatus that can print a color image.

Referring to FIG. 1, a plurality of developing units 10C, 10M, 10M, and 10K for printing a color image can be vertically mounted in the electro-photographic image forming apparatus. Photosensitive media 15C, 15M, 15Y, and 15K, on which an electrostatic latent image is formed by light scanned from a light scanning unit (not shown), are mounted in the housings 12C, 12M, 12Y, and 12K of the developing units 10C, 10M, 10M, and 10K, respectively. One side of each of the photosensitive media 15C, 15M, 15Y, and 15K is opened to the outside of the housings 12C, 12M, 12Y, and 12K for printing the color image on printing papers. Also, developing agents, that is, toners, of cyan (C), magenta (M), yellow (Y), and black (B) colors for displaying the electrostatic latent images in cyan (C), magenta (M), yellow (Y), and black (K) colors are respectively filled in each of the housings 12C, 12M, 12Y, and 12K.

When the photosensitive media 15C, 15M, 15Y, and 15K are used for long hours, a light fatigue phenomenon, that is, reduced sensitivity to light, can occur. Then, the photosensitive media must be replaced since clear image printing is impossible. The light fatigue phenomenon may appear early if the photosensitive media are exposed to external bright light often and for long hours.

However, the four developing units 10C, 10M, 10M, and 10K depicted in FIG. 1 are disposed close to each other. Therefore, it is difficult to mount photosensitive medium shutters for shielding external light on each developing unit 10C, 10M, 10M, and 10K due to a narrow available inner space. It has been reported that some developing units have a photosensitive medium shutter that shields external light using a thin non-transparent film. However, the thin non-transparent film is not safe enough to protect the photosensitive media from an external impact, that is, there is a high risk of damaging the photosensitive media.

Accordingly, a need exists for an electro-photographic image forming apparatus having an improved developing unit that substantially prevents exposing the photosensitive medium to light.

SUMMARY OF THE INVENTION

The present invention provides a developing unit having a photosensitive medium shutter that may be mounted in a small space and an electro-photographic image forming apparatus having the developing unit.

The present invention also provides a developing unit having a photosensitive medium shutter that has less possibility of being damaged by an external impact than a conventional photosensitive medium shutter and an electro-photographic image forming apparatus having the developing unit.

According to an aspect of the present invention, a developing unit includes a housing, and a photosensitive medium. An end of the photosensitive medium is exposed to the outer side of the housing and is rotatably mounted on the housing. A photosensitive medium shutter shields the exposed part of the photosensitive medium when a door is opened and exposes the exposed part of the photosensitive medium to the outside when the door is closed. The photosensitive medium shutter includes a first shielding plate that may be moved between a first location where the exposed part is shielded and a second location where the exposed part is exposed to the outside of the housing. A second shielding plate is spread at the first location with respect to the first shielding plate and is overlapped with the first shielding plate at the second location.

The second shielding plate may be slidably connected to the first shielding plate. The second shielding plate may be stopped by the housing and the first shielding plate may be overlapped with the second shielding plate by sliding with respect to the second shielding plate when the first shielding plate moves from the first location to the second location.

The first shielding plate may include a slot that accommodates the second shielding plate. The second shielding plate may be mounted by inserting it into the first shielding plate to protrude therefrom.

The second shielding plate may be elastically biased in a spread direction with respect to the first shielding plate.

The first shielding plate and the second shielding plate may have a greater strength than a film.

The first shielding plate may be elastically biased to locate in the first location.

According to another aspect of the present invention, an electro-photographic image forming apparatus includes a case on which a door is provided. A developing unit is mounted to be able to separate from an inner side of the case when opening the door. The developing unit includes a housing, a photosensitive medium. An end of the photosensitive medium is exposed to the outer side of the housing and is rotatably mounted on the housing. A photosensitive medium shutter shields the exposed part of the photosensitive medium when a door is opened and exposes the exposed part of the photosensitive medium to the outside when the door is closed. The photosensitive medium shutter includes a first shielding plate that may be moved between a first location where the exposed part is shielded and a second location where the exposed part is exposed to the outside of the housing and a second shielding plate that is spread at the first location with respect to the first shielding plate and is overlapped with the first shielding plate at the second location.

The second shielding plate may be slidably connected to the first shielding plate. The second shielding plate may be stopped by the housing and the first shielding plate may be overlapped with the second shielding plate by sliding with respect to the second shielding plate when the first shielding plate moves from the first location to the second location.

The first shielding plate may include a slot that accommodates the second shielding plate. The second shielding plate may be mounted by inserting it into the first shielding plate to be able to protrude.

The second shielding plate may be elastically biased in a spread direction with respect to the first shielding plate.

The first shielding plate and the second shielding plate may have a greater strength than a film.

The first shielding plate may be elastically biased to locate in the first location.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

A developing unit and an electro-photographic image forming apparatus having the same according to exemplary embodiments of the present invention are described with reference to the accompanying drawings.

Figure 1:
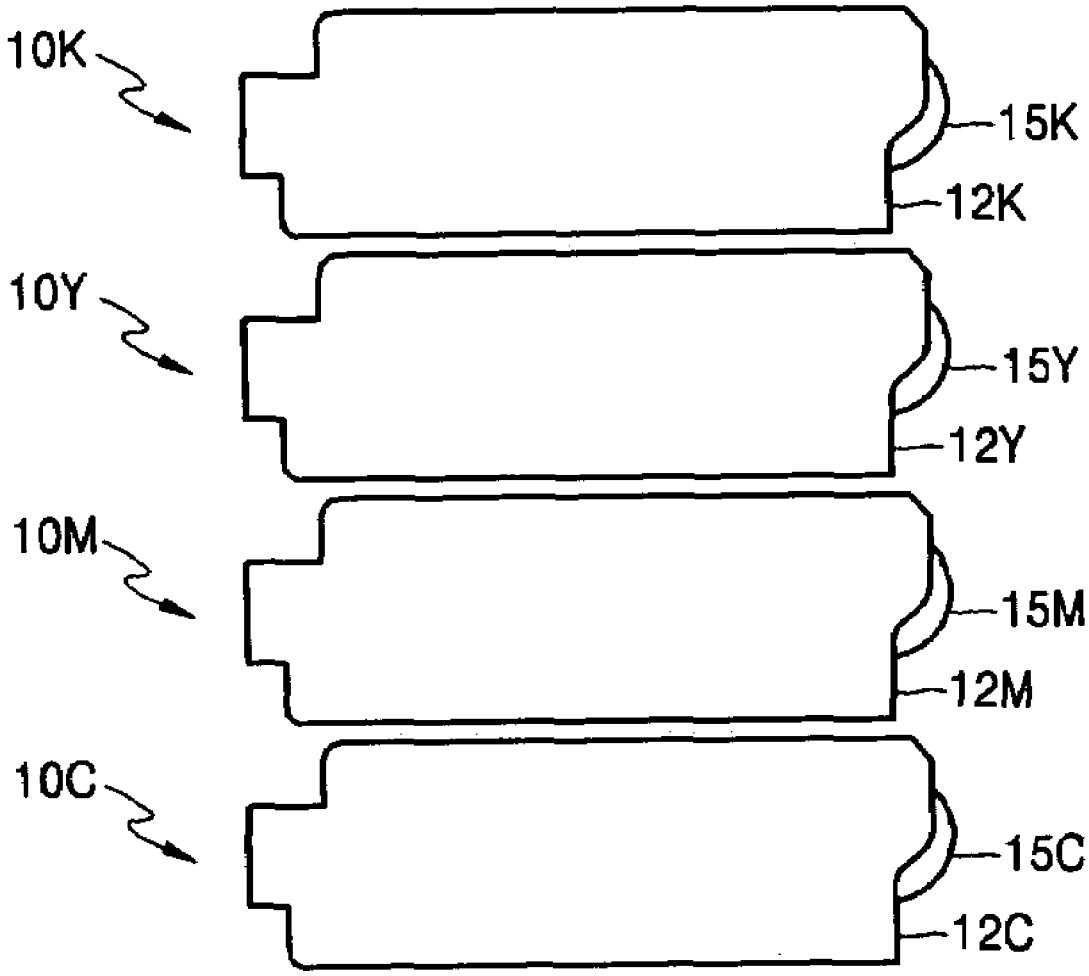
FIG. 1 (PRIOR ART)
FIG. 1 is a side view illustrating a conventional developing unit mounted in an inner side of an electro-photographic image forming apparatus.
Figure 2:
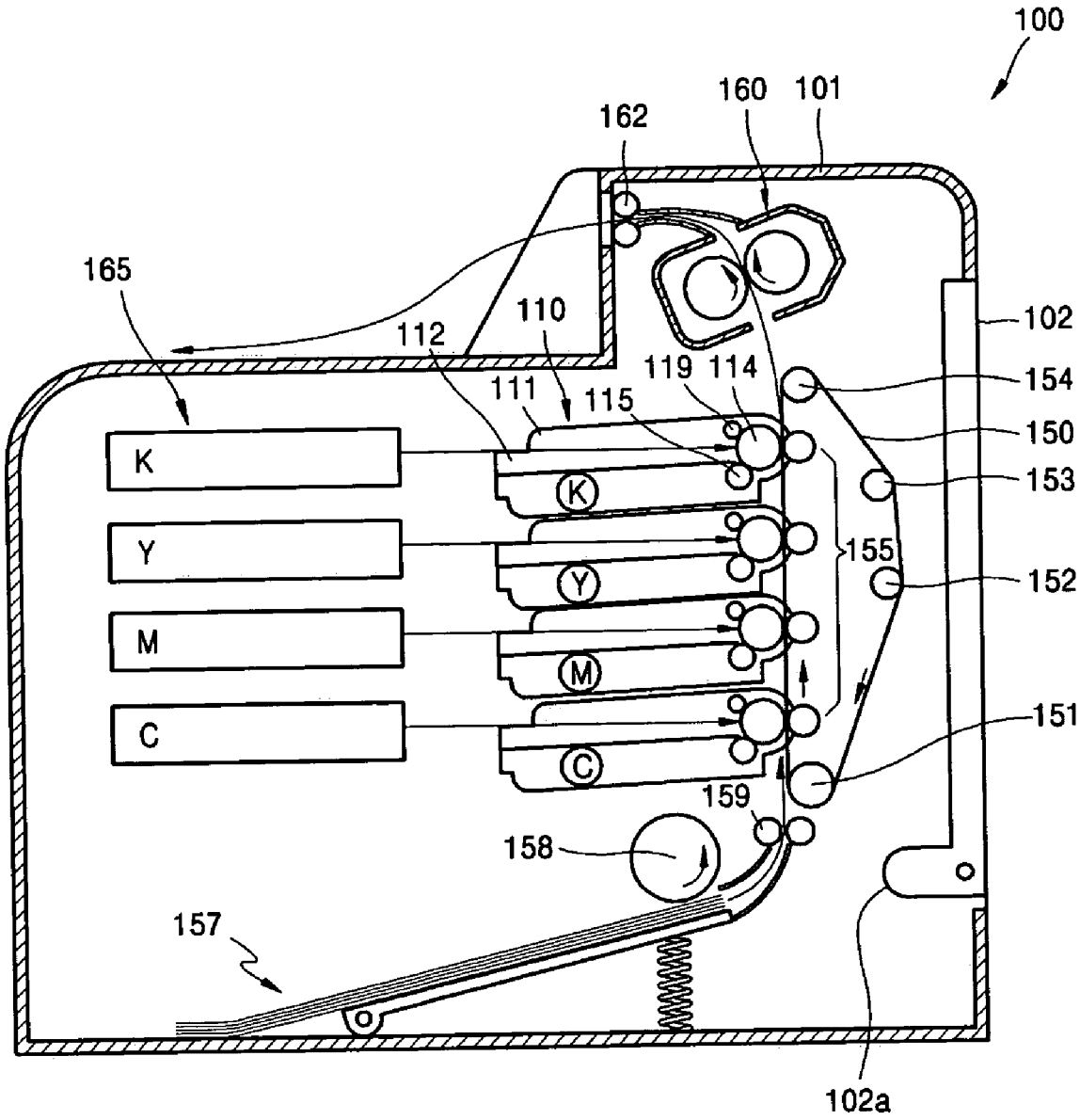
FIG. 2 is a cross-sectional view of an electro-photographic image forming apparatus according to an exemplary embodiment of the present invention.

FIG. 2 is a cross-sectional view of an electro-photographic image forming apparatus according to an embodiment of the present invention.

Referring to FIG. 2, the electro-photographic image forming apparatus 100 that prints color images includes a case 101, four developing units 110C, 110M, 110Y, and 110K and four light scanning units 165C, 165M, 165Y, and 165K disposed in the case 101, a transferring belt 150, four transferring rollers 155, and a fixing unit 160. The electro-photographic image forming apparatus includes a cassette 157 where sheets of paper are stacked, a pick up roller 158 that picks up a sheets of paper at a time from the cassette 157, a conveying roller 159 that conveys the sheets of picked up paper, and a paper discharge roller 162 that discharges the sheets of papers on which images are printed from the case 101.

Each of the developing units 110C, 110M, 110Y, and 110K depicted in FIG. 2 is a replaceable cartridge that may be replaced with a new cartridge when a developing agent (toner) contained therein is exhausted. Each of the developing units 110C, 110M, 110Y, and 110K contain a different color toner, such as cyan (C), magenta (M), yellow (Y), and black (K) for printing color images. The developing units 110C, 110M, 110Y, and 110K may be replaced by opening a door 102 installed on a side of the case 101 since the transferring belt 150 and pulleys 151 through 154 that support the transferring belt 150 and the transferring rollers 155 are horizontally arranged in connection with the opening of the door 102.

The transferring belt 150 circulates in upward and downward directions by being supported by the pulleys 151 through 154. In an exemplary embodiment, four light scanning units 165C, 165M, 165Y, and 165K are included corresponding to the four developing units 110C, 110M, 110Y, and 110K. Each of the light scanning units 165C, 165M, 165Y, and 165K scan light corresponding to the image information of the cyan (C), magenta (M), yellow (Y), and black (B) color to photosensitive media 114C, 114M, 114Y, and 114K mounted in each housing 111C, 111M, 111Y, and 111K of the developing units 110C, 110M, 110Y, and 110K. The light scanning units 165C, 165M, 165Y, and 165K may be a laser scanning unit (LSU) that uses a laser diode as a light source.

Each of the developing units 110C, 110M, 110Y, and 110K includes a photosensitive medium 114C, 114M, 114Y, and 114K and a developing roller 115C, 115M, 115Y, and 115K disposed in the housing 111C, 111M, 111Y, and 111K. A portion of a circumferential surface of the photosensitive medium 114C, 114M, 114Y, and 114K that faces the transferring belt 150 is exposed to the outside of the housing 111C, 111M, 111Y, and 111K when printing is performed. Also, each of the developing units 110C, 110M, 110Y, and 110K includes respective charged rollers 119C, 119M, 119Y, and 119K. A charge bias voltage is applied to each of the charged rollers 119C, 119M, 119Y, and 119K for charging the circumferential surface of the photosensitive medium 114C, 114M, 114Y, and 114K to a uniform potential. The developing roller 115C, 115M, 115Y, and 115K supplies toner to the photosensitive medium 114C, 114M, 114Y, and 114K and adheres the toner on a circumferential surface of the developing roller 115C, 115M, 115Y, and 115K. A developing bias voltage for supplying toner to the photosensitive medium 114C, 114M, 114Y, and 114K is applied to the developing roller 115C, 115M, 115Y, and 115K. Although not shown in the drawing, a supplying roller that supplies toner to the developing roller 115C, 115M, 115Y, and 115K, a doctor blade that controls the quantity of toner adhered to the developing rollers 115C, 115M, 115Y, and 115K, and an agitator in the form of a conveyor belt that conveys the toner held in the housing 111 to the supplying roller may further be included in the housing 111C, 111M, 111Y, and 111K. Each of the developing units 110C, 110M, 110Y, and 110K according to an exemplary embodiment of the present invention respectively includes an opening 112C, 112M, 112Y, and 112K that forms a passage so that light scanned from the light scanning unit 165C, 165M, 165Y, and 165K may be scanned to the photosensitive medium 114C, 114M, 114Y, and 114K.

The four transferring rollers 155 are disposed on locations facing each of the photosensitive medium 114C, 114M, 114Y, and 114K and the transferring belt 150 is disposed therebetween. A transferring bias voltage is applied to the transferring roller 155.

The color image forming process of the electro-photographic image forming apparatus is described below.

The photosensitive medium 114C, 114M, 114Y, and 114K is charged with a uniform potential by a charge bias voltage applied to the charged roller 119C, 119M, 119Y, and 119K. The four light scanning units 165C, 165M, 165Y, and 165K scan light corresponding to each of the image information of the cyan (C), magenta (M), yellow (Y), and black (K) colors to the photosensitive media 114C, 114M, 114Y, and 114K through openings 112C, 112M, 112Y, and 112K. Then, an electrostatic latent image is formed on a circumferential surface of the photosensitive media 114C, 114M, 114Y, and 114K. A developing bias voltage is applied to the developing rollers 115C, 115M, 115Y, and 115K. Then, the toner is moved to the circumferential surface of the photosensitive media 114C, 114M, 114Y, and 114K and a visible image in cyan (C), magenta (M), yellow (Y), and black (K) is respectively developed thereon.

A sheet of paper is picked up from a cassette 157 by a pickup roller 158 and transported to the transferring belt 150 by a conveying roller 159. The sheet of paper is conveyed at the same speed of the circulation of the transferring belt 150 by adhering it on a surface of the transferring belt 150 by an electrostatic force.

An end of the sheet of paper being conveyed by being adhered on the surface of the transferring belt 150 arrives at a transferring nip when an end of the visible image of the cyan color formed on the circumferential surface of the photosensitive medium 114C arrives at the transferring nip faced the transferring roller 155. At this time, the visible image formed on the photosensitive medium 114C is transferred to the sheet of paper when a transferring bias voltage is applied to the transferring roller 155. As the sheet of paper moves continuously, an image is formed thereon by sequentially transferring visible images of magenta (M), yellow (Y), and black (K) colors formed on the circumferential surfaces of other photosensitive media 114M, 114Y, and 114K by overlapping. A fixing unit 160 fixes an image on the sheet of paper by applying heat and pressure on the color visible image formed thereon. The paper on which fixing is completed is discharged to the outside of the case 101 by a paper discharge roller 162.

Figure 3:
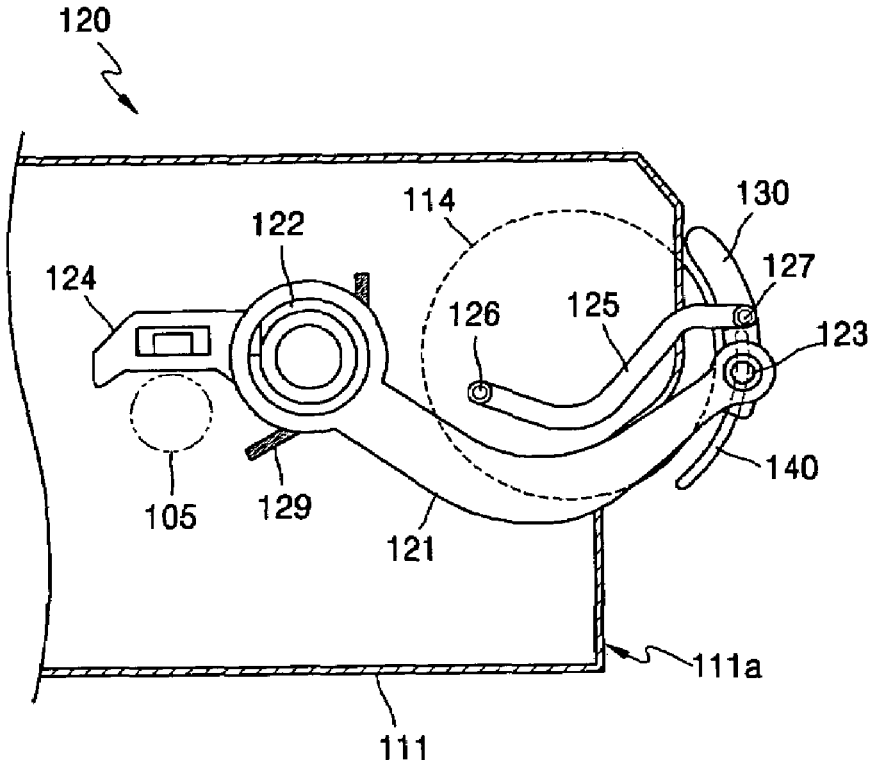
FIGS. 3 and 4 are side elevational views of a developing unit according to exemplary embodiments of the present invention, FIG. 3 illustrating a shielded state of a photosensitive medium and FIG. 4 illustrating an exposed state of the photosensitive medium.
Figure 4:
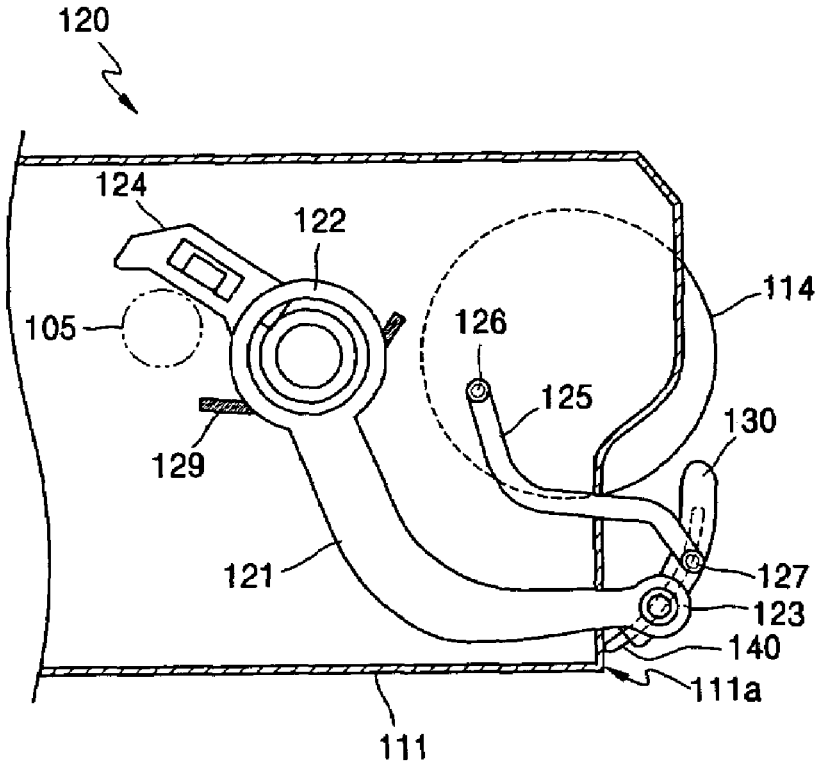

Each of the developing units 110C, 110M, 110Y, and 110K includes a photosensitive medium shutter 120 for preventing the exposure of the photosensitive media 114C, 114M, 114Y, and 114K to the external light when the door 102 of the case 101 is opened, as shown in FIGS. 3 and 4. Hereinafter, a photosensitive medium shutter 120 included in each of the developing unit 110C, 110M, 110Y, and 110K is described.

Referring to FIGS. 3 and 4, the photosensitive medium shutter 120 includes a pair of first arms 121, wherein a first end of each of the first arms 121 is mounted to be able to rotate on both sides of the housing 111 of a developing unit. A first end of each of a pair of second arms 125 is mounted to be able to rotate on different locations from the first arms 121.

A second end 123 of each of the first arms 121 and a second end 127 of each of the second arms 125 are respectively hinged to a first shielding plate 130 that shields the exposure of the photosensitive medium 114. The first shielding plate 130 may be moved between a first location that shields an exposed portion of the photosensitive medium 114 exposed to the outside of the housing 111 as depicted in FIG. 3 and a second location that exposes the exposed portion of the photosensitive medium 114 to the outside as depicted in FIG. 4 since the first arm 121 is rotating with respect to an end part 122 of the first arm 121.

The second shielding plate 140 is connected to be able to slide with respect to the first shielding plate 130. The second shielding plate 140, as depicted in FIG. 3, shields the exposed portion of the photosensitive medium 114 by protruding downwardly from the first shielding plate 130 at the first location. As shown in FIG. 4, the second shielding plate 140 is inserted in the first shielding plate 130 at the second location.

The first shielding plate 130 and the second shielding plate 140 are preferably formed of an opaque plastic resin for blocking light and have a thickness greater than a film having an appropriate strength, preferably greater than about 0.3 mm, thereby protecting the photosensitive medium 114 from external impacts.

A protruded lever 124 is provided on an end 122 of the first arm 121. The lever 124 is pushed up by a pusher 105 that is moved up in connection with the opening and closing of a door 102 (in FIG. 2) mounted on an external case 101 (refer to FIG. 2). When the lever 124 is pushed up, as shown in FIG. 4, the first shielding plate 130 is moved to the second location by the rotation of the first arm 121 with respect to an end 122 of the first arm 121 and the rotation of a second arm 125 with respect to an end 126 of the second arm 125.

A torsion spring 129 is mounted on an end of the first arm 121. The second end 123 of the first arm 121 is elastically biased in an upward direction by the torsion spring 129. Then, the first shielding plate 130 is elastically biased to the first location where the exposed portion of the photosensitive medium 114 is shielded. Therefore, when the door 102 is opened and the pusher 105 connected to the door 102 is lowered, as shown in FIG. 3, the first shielding plate 130 is returned to the first location.

Figure 5:
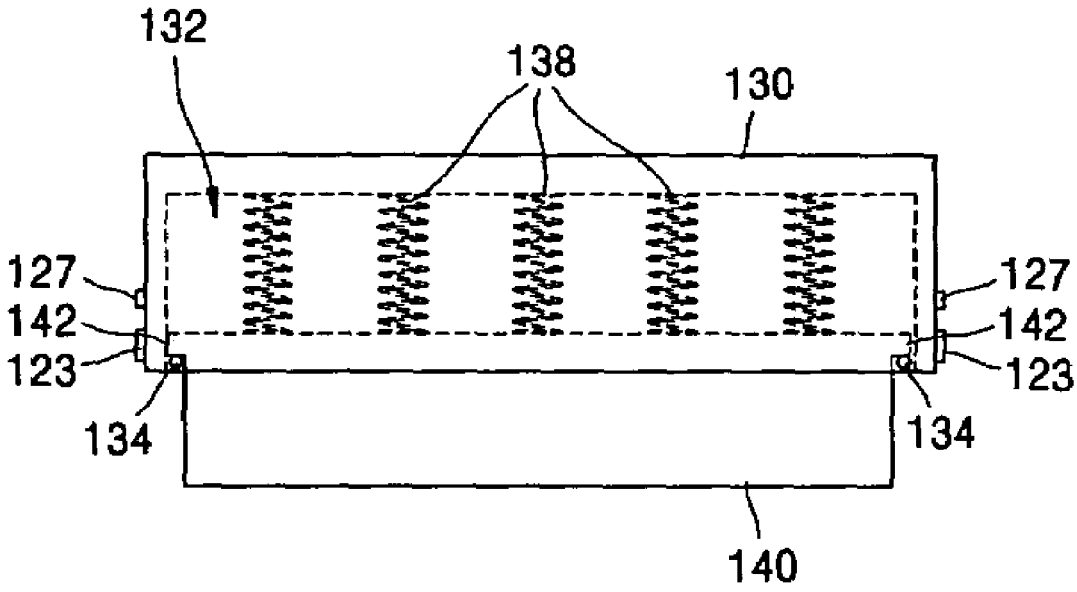
FIGS. 5 and 6 are schematic drawings of shielding plates of the developing unit according to exemplary embodiments of the present invention, FIG. 5 illustrating an opened state of a second shielding plate with respect to a first shielding plate and FIG. 6 illustrating a folded state of the second shielding plate with respect to the first shielding plate.
Figure 6:
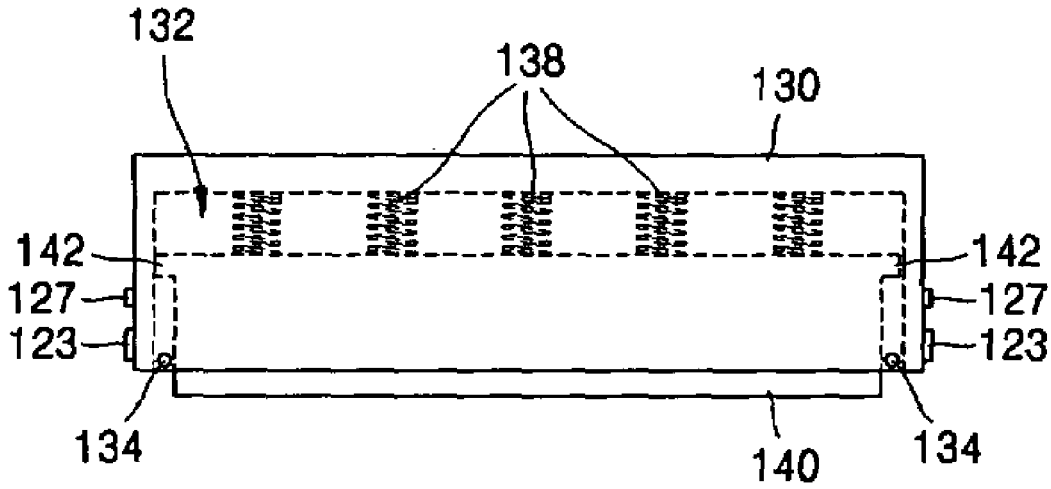

Referring to FIGS. 5 and 6, a slot 132 opened to a lower part is formed in the first shielding plate 130, and the second shielding plate 140 is accommodated in the slot 132. A pair of stoppers 134 prevent the second shielding plate 140 from escaping from the slot 132 are provided on both sides of an inlet of the slot 132 and a pair of protrusion parts 142 corresponding to the stoppers 134 are formed on both sides of the second shielding plate 140. A plurality of coil springs 138 are disposed between an upper surface of the second shielding plate 140 and a ceiling of the slot 132. The second shielding plate 140 is elastically biased in a downward protrusion direction, that is, in a spreading direction, with respect to the first shielding plate 130.

The operation of the photosensitive medium shutter 120 is described below with reference to FIGS. 2 through 6.

The first shielding plate 130 is located at the first location where the first shielding plate 130 shields the exposed portion of the photosensitive medium 114 by the elastic force of the torsion springs 129 if the developing unit 110 is separated from the electro-photographic image forming apparatus 100 or placed in the electro-photographic image forming apparatus 100 when the door is opened. At this time, the second shielding plate 140 shields an exposed portion of the photosensitive medium 114 that is not shielded by the first shielding plate 130 by protruding downwardly by the elastic force of the coil spring 138. At this time, the second shielding plate 140 is not separated from the first shielding plate 130 since the pair of protrusion parts 142 of the second shielding plate 140 are blocked by the pair of stoppers 134 in the slot 132.

When the door 102 is closed after mounting the developing unit 110 in the electro-photographic image forming apparatus 100, the lever 124 is pushed up by the pusher 105 which is moved up in connection with the opening and closing of the door 102. The first shielding plate 130 is lowered to the second location by the rotation of the first arm 121 and the second arm 125. When the first shielding plate 130 is lowered, a lower part of the second shielding plate 140 is stopped by a lower front part 111*a* of the housing, and the first shielding plate 130 and the second shielding plate 140 are overlapped by the further lowering of the first shielding plate 130. Therefore, the photosensitive medium 114 is exposed to the transferring belt 150, and then, a state that the transferring of an image is possible is achieved.

Figure 7:
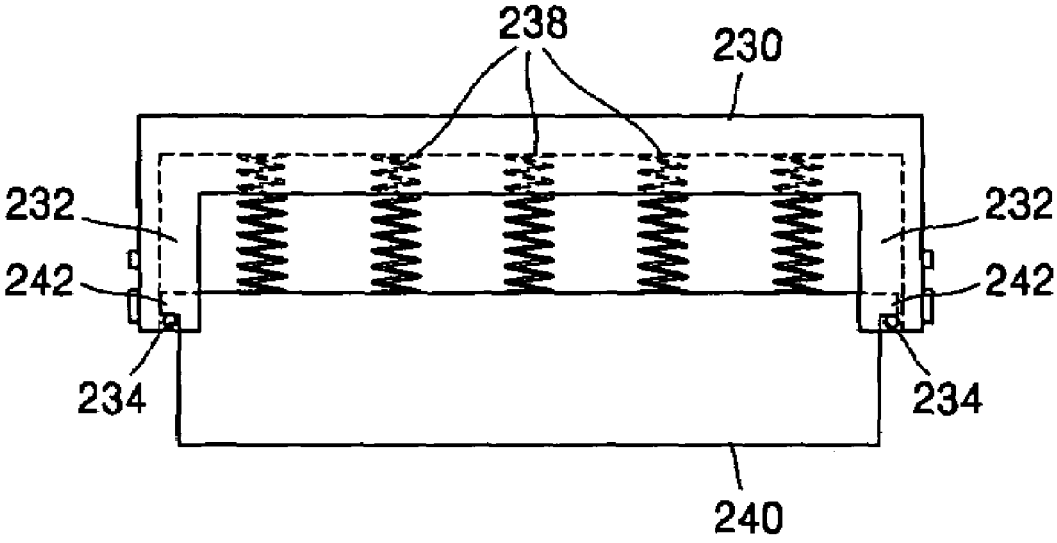
FIGS. 7 and 8 are schematic drawings of shielding plates according to a second embodiment of the present invention, FIG. 7 illustrating an opened state of a second shielding plate with respect to a first shielding plate and FIG. 8 illustrating a folded state of the second shielding plate with respect to the first shielding plate.
Figure 8:
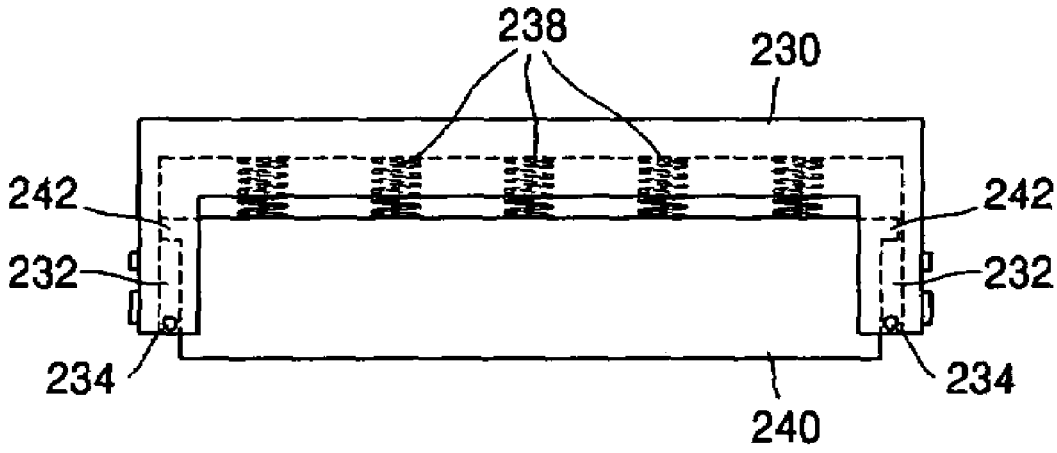

FIGS. 7 and 8 are schematic drawings of shielding plates according to a second exemplary embodiment of the present invention, wherein FIG. 7 illustrates an opened state of a second shielding plate with respect to a first shielding plate and FIG. 8 illustrates a folded state of the second shielding plate with respect to the first shielding plate. The first and second shielding plates of the developing unit according to the second exemplary embodiment are different in shape from the first and second shielding plates of the developing unit according to the first exemplary embodiment, and the difference are described below.

Referring to FIGS. 7 and 8, a pair of guide grooves 232 that guide the up and down motion of a second shielding plate 240 are formed on both side ends of a first shielding plate 230. Both side ends of the second shielding plate 240 are mounted on the guide grooves 232 to move up and down with respect to the first shielding plate 230. A pair of stoppers 234 are provided on an inlet of the pair of the guide grooves 232 so that the second shielding plate 240 cannot be separated from the guide grooves 232. A pair of protrusion parts 242 corresponding to the stoppers 234 are provided on both side ends of an upper part of the second shielding plate 240. A plurality of coil springs 238 are disposed between an upper part of the second shielding plate 240 and an upper inner wall of the first shielding plate 230. The second shielding plate 240 is elastically biased in a downward direction with respect to the first shielding plate 230 by the coil springs 238. The operation of a photosensitive medium shutter mounted in the developing unit according to the second exemplary embodiment is identical to that of the first exemplary embodiment.

A developing unit and an electro-photographic image forming apparatus having the developing unit prevent a photosensitive medium from lifetime shortening by light fatigue by providing a photosensitive medium shutter that shields an exposure of the photosensitive medium.

Also, the photosensitive medium shutter may be placed in a small space since the photosensitive medium shutter includes first and second shielding plates that are opened when the photosensitive medium is shielded and are overlapped when the photosensitive medium is exposed.

Also, according to the exemplary embodiments of the present invention, the first and second shielding plates protect the photosensitive medium from an external impact since the first and second shielding plates have greater strength than a film.

While the present invention has been particularly shown and described with reference to embodiments thereof, it will be understood by those of ordinary skill in the art that various changes in form and details may be made therein without departing from the spirit and scope of the present invention as defined by the following claims.

What is claimed is:

1. A developing unit, comprising:

a housing;

a photosensitive medium rotatably mounted on the housing, an end of the photosensitive medium being exposed outside the housing; and a photosensitive medium shutter shields the exposed part of the photosensitive medium when a door is opened and exposes the exposed part of the photosensitive medium to the outside when the door is closed, the photosensitive medium shutter including a first shielding plate movable between a first location where the exposed part is shielded and a second location where the exposed part is exposed outside of the housing and a second shielding plate that is spread at the first location with respect to the first shielding plate and is overlapped with the first shielding plate at the second location.

2. The developing unit of claim 1, wherein the second shielding plate is slidably connected to the first shielding plate.

3. The developing unit of claim 2, wherein movement of the second shielding plate at the second location is stopped by the housing.

4. The developing unit of claim 3, wherein the first shielding plate is overlapped with the second shielding plate by sliding with respect to the second shielding plate when the first shielding plate moves from the first location to the second location.

5. The developing unit of claim 4, wherein the first shielding plate includes a slot to accommodate the second shielding plate, and the second shielding plate is mounted by inserting it into the first shielding plate to be able to protrude therefrom.

6. The developing unit of claim 4, wherein the second shielding plate is elastically biased in a spread direction with respect to the first shielding plate.

7. The developing unit of claim 6, wherein a plurality of coil springs are disposed in the first shielding plate to elastically bias the second shielding plate.

8. The developing unit of claim 6, wherein a pair of stoppers connected to the first shielding plate engage a pair of protrusions extending from the second shielding plate to prevent the second shielding plate from being moved out of the first shielding plate.

9. The developing unit of claim 1, wherein the first shielding plate and the second shielding plate have a greater strength than that of a film.

10. The developing unit of claim 1, wherein the first and second shielding plates are made of an opaque plastic resin.

11. The developing unit of claim 1, wherein the first shielding plate is elastically biased to the first location.

12. An electro-photographic image forming apparatus, comprising:

a case having a door to access inside the case; and a developing unit removably mounted in the case to be able to separate from the inside of the case when opening the door the developing unit including a housing;

a photosensitive medium having an end exposed outside of the housing and rotatably mounted on the housing; and a photosensitive medium shutter that shields the exposed part of the photosensitive medium when a door is opened and exposes the exposed part of the photosensitive medium to the outside when the door is closed, the photosensitive medium shutter having a first shielding plate that is movable between a first location where the exposed part is shielded and a second location where the exposed part is exposed to the outside of the housing and a second shielding plate that is spread at the first location with respect to the first shielding plate and is overlapped with the first shielding plate at the second location.

13. The electro-photographic image forming apparatus of claim 12, wherein the second shielding plate is slidably connected to the first shielding plate.

14. The electro-photographic image forming apparatus of claim 13, wherein the second shielding plate is stopped by the housing at the second location.

15. The electro-photographic image forming apparatus of claim 14, wherein the first shielding plate is overlapped with the second shielding plate by sliding with respect to the second shielding plate when the first shielding plate moves from the first location to the second location.

16. The electro-photographic image forming apparatus of claim 15, wherein the first shielding plate includes a slot to accommodate the second shielding plate and the second shielding plate is mounted by inserting it into the first shielding plate to be able to protrude therefrom.

17. The electro-photographic image forming apparatus of claim 15, wherein the second shielding plate is elastically biased in a spread direction with respect to the first shielding plate.

18. The electro-photographic image forming apparatus of claim 12, wherein the first shielding plate and the second shielding plate have a greater strength than that of a film.

19. The electro-photographic image forming apparatus of claim 12, wherein the first shielding plate is elastically biased to locate in the first location.

20. The electro-photographic image forming apparatus of claim 12, wherein the first and second shielding plates are made of an opaque plastic resin.

* * * * *